US005118061A

United States Patent [19]

Byrne et al.

[11] Patent Number: 5,118,061

[45] Date of Patent: Jun. 2, 1992

[54] PITON ASSEMBLY

[76] Inventors: Thomas F. Byrne, P.O. Box 7404, Boulder, Colo. 80306; Edward Gitlin, 5420 Arapahoe Ave., Boulder, Colo. 80303

[21] Appl. No.: 648,189

[22] Filed: Jan. 31, 1991

[51] Int. Cl.[5] ..... A47F 5/08

[52] U.S. Cl. ..... 248/231.9; 248/925; 411/400

[58] Field of Search ..... 248/200, 231.9, 925, 248/317, 508; 411/400, 401

[56] References Cited

U.S. PATENT DOCUMENTS 4,064,665 12/1977 Lowe et al. ..... 411/456 X
4,231,247 11/1988 Haydon ..... 411/400 X
4,715,568 12/1988 Best, Jr. ..... 248/928 X
4,770,376 9/1989 Lindblom ..... 248/231.9
4,884,931 12/1989 Revol et al. ..... 248/231.9 X

*Primary Examiner*—Ramon O. Ramirez
*Attorney, Agent, or Firm*—Thomas A. Beck

[57] ABSTRACT

An ice piton assembly used for ice climbing comprising a hollow tube onto which a strike absorbent ear capable of being hammered is fitted and secured into a pre-notched section of said tube so as to impart the force of the blow down the approximate center of the tube. At one end of said tube is a swivel assembly that rotates in one position and is fitted in the other and to which the climber attaches the rope. The ice piton has a feature particular to the demands of climbing in that the swivel assembly adjusts to assure the most effective downward pull regardless of the position of the piton.

1 Claim, 4 Drawing Sheets

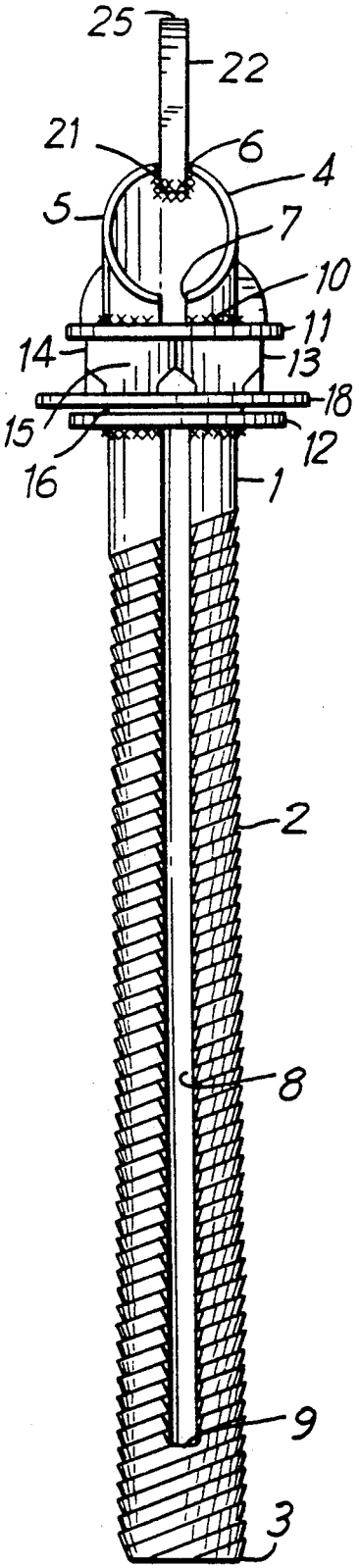
FIG. 1
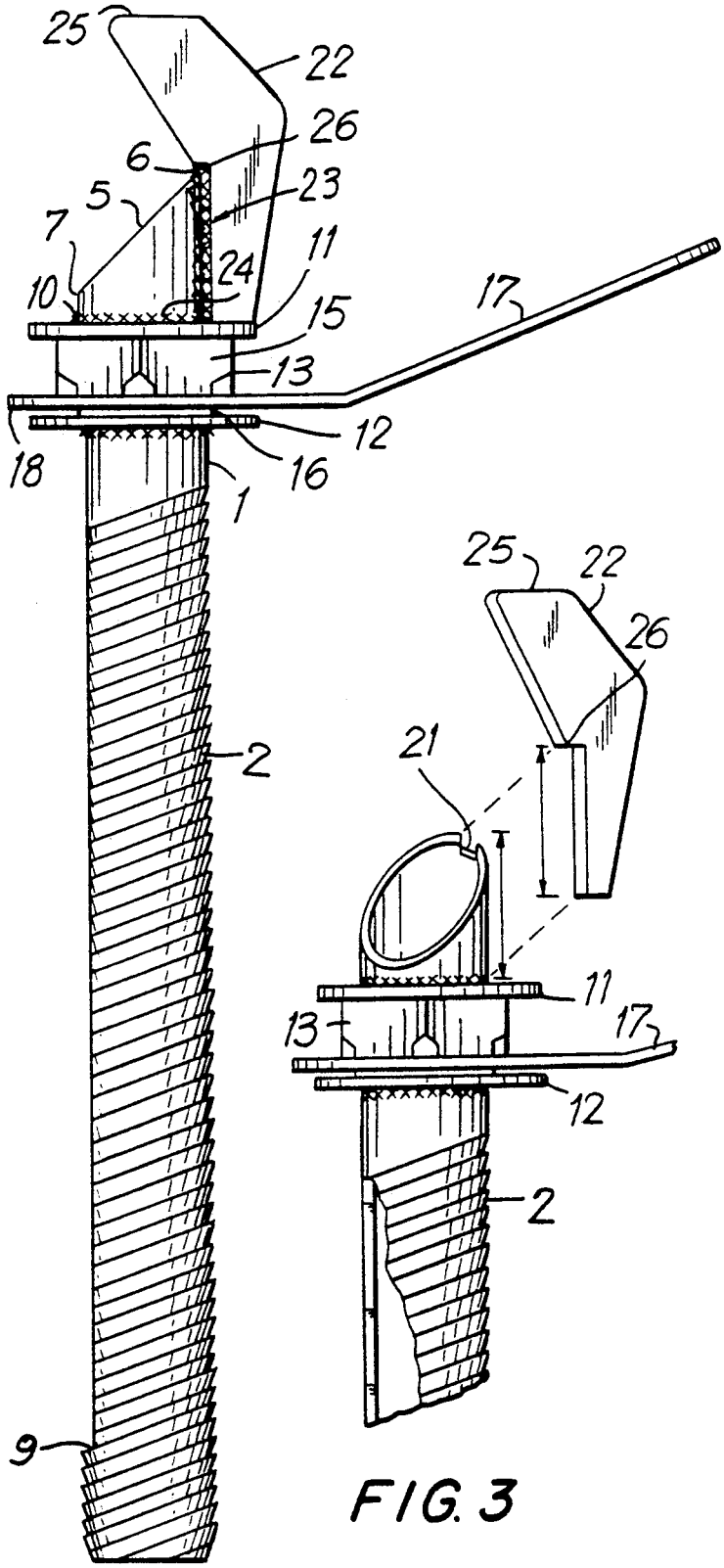
FIG. 2
FIG. 3

PITON ASSEMBLY

BACKGROUND OF THE INVENTION

The invention relates generally to an article used in the field of technical climbing and mountaineering, but is not limited to this use. The article is generally referred to as an ice piton and is utilized by securing same in a climbing medium to assist technical climbers.

DESCRIPTION OF THE PRIOR ART

Generally, the act of climbing a hill, mountain or any other type of elevated land formation using the feet and generally not the hands is referred to as "mountaineering". Thus one essentially "walks" up a hill, etc. and may use his or her hands for balancing or assistance, however, the prime source of movement is walking up the hill with the feet and legs.

By contrast, technical climbing involves the act of climbing where both the hands and feet serve to cooperate to ascend the mountain. One uses implements in a technical climb. For example, when scaling a vertical face of a mountain, one could not simply walk up the vertical face as would be done in mountaineering. In such event, one must use special implements and tools along with one's hands and feet to assist in scaling the vertical face of the mountain. For example, technical climbers use different types of pitons which are implanted in the surface being climbed to secure their position by attaching a safety rope from their body to the piton. In the event the climber should fall from his position, the piton will hold the climber.

There are different types of pitons for different mediums, for example, rock and ice. The present invention relates to a piton for ice.

U.S. Pat. No. 4,064,665 discloses a tube for placement in a frozen medium. One feature lacking in this prior art reference, is that there is no viable means for extracting the piton from the ice. Unlike the present invention, ice climbing pitons found in the prior art do not provide a convenient rotatable handle into which a carabiner can be clipped that also functions as a mechanism for removing the piton for the ice.

BRIEF DESCRIPTION OF THE DRAWINGS

FIG. 1 depicts a front view of the ice piton of the present invention.

FIG. 2 depicts a side view of the ice piton of the present invention.

FIG. 3 depicts an oblique view of the top section of the ice piton of the present invention to FIG. 2 showing the unique attachment of the ledge of the ear piece into the notch formed in the tube.

SUMMARY OF THE INVENTION

Figure 4:
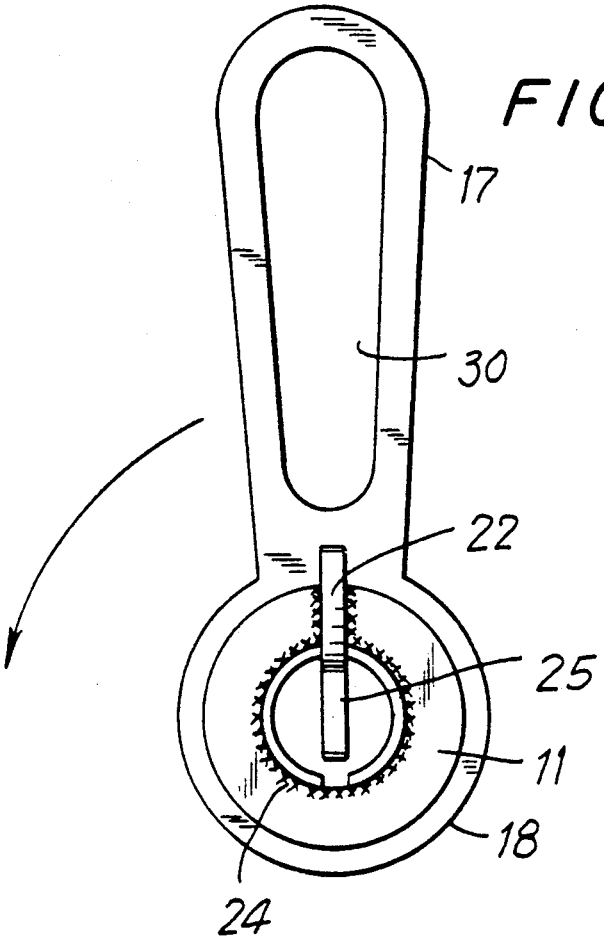
FIGS. 4 and 4A depict top views looking down on the assembly of FIGS. 1 or 2 with the handle at different radial positions.

The invention relates to a tubular ice piton device that is driven into snow or ice such that will hold the climber in the event the climber slips from his position and falls. The piton also comprises a handle means secured to a portion of the tabular piton, said handle having an opening therein suitable for attaching a carabiner in such a way that the attachment handle rotates while the tubular splined hollow shaft of the ice piton stays stationary in the frozen medium.

It is an object of the invention to provide for a striking area or ear on the top of the piton so configured and assembled that the piton assembly is driven in line with the direction of the blow when it is hit by a hammer or other suitable striking means. By localizing the point of strike on the top of the ear, the energy from the blow is transmitted most effectively to the base of the piton. Accordingly, as a result the piton will not skew or glance to one side resulting in its being dropped or fracturing the ice. This adaptation makes the act of climbing safer and more efficient in the expenditure of the climber's energy.

DESCRIPTION OF THE PREFERRED EMBODIMENT

Referring to FIG. 1, the ice piton assembly of the present invention comprises a tubular externally threaded hollow shaft 2 having a bevelled first end 3 that is suitable for fixing in an ice-like medium. The opposite (second) end 4 of said hollow shaft 2 is cut in a diagonal plane across its longitudinal configuration 5. Thus, when measuring from bevelled end 3, to the opposite truncated end of the shaft, there is a point of maximum length 6 and a point of minimum length 7 on the truncated (second) end.

Hollow shaft 2 possesses a spline or slot 8 extending along a portion of the length of said shaft starting at 9 through the opposite end point 7. At a distance 10 removed from the minimum edge point 7 of said truncated end 5, are a first flange 11 and a second flange 12 that are separated by a ring attachment 13 positioned over said shaft 2, the first portion 14 of which comprises a bolt head-like multifaceted peripheral surface 15 and immediately adjacent thereto, a second portion 16 which comprises a circular peripheral surface. An attachment handle 17 (not shown) having at one end a circular portion 18 having an opening 18, is positioned between said flanges 12 and 13. The top or ear section 21 of the piton is described more fully in FIG. 2.

FIG. 2 depicts a side view of the piton described above and depicted in FIG. 1 except that the threaded portion of the shaft 2 and a pronounced bevelled end 3 is not depicted.

Attachment handle 17 is shown in the rest position so that 18' which surrounds the ring attachment 13 is positioned so that it envelopes the circular peripheral surface 16 of ring attachment 13.

At the point of maximum length 6 on the edge of shaft 2, a notch 21 (See FIG. 3) is removed and a horizontal bottom section ledge or lip piece 26 of ear piece 22 rests in said notch 21. Ear piece 22 has a horizontal top surface 25 which extends substantially parallel to first flange 11, second flange 12 and lip piece 26.

FIG. 3 depicts an oblique exploded view of the upper end of the assembly along with the handle. As shown, maximum length point 6 has a notch 21 into which the horizontal bottom piece (lip piece) 26 is inserted.

Figure 4A:
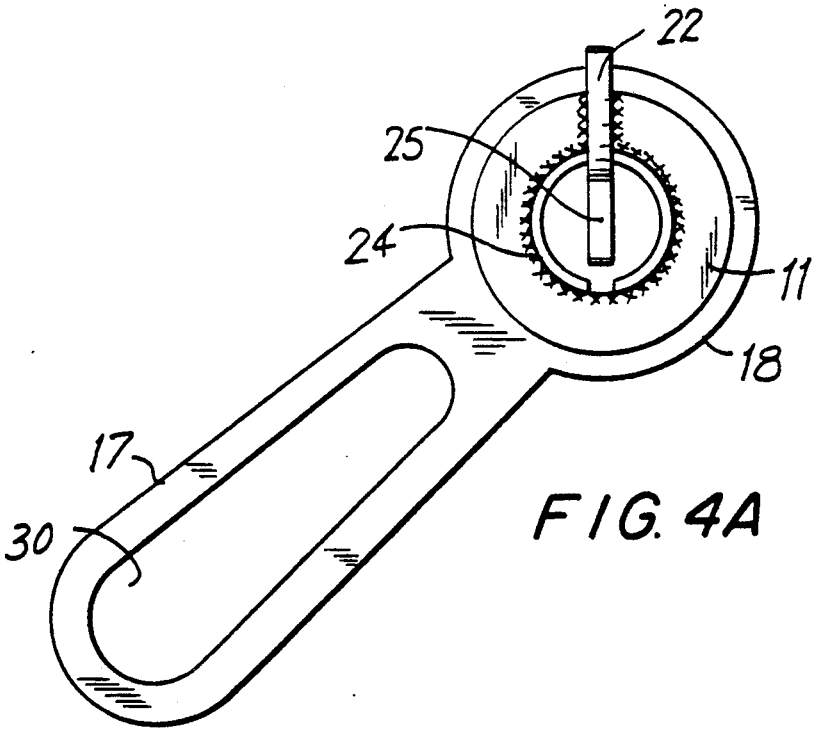

FIGS. 4 and 4A show a top view of the assembly with the top surface 25 of ear piece 22, first flange 11 and handle 17. In FIG. 4A the handle has been rotated about 120°. Handle 17 has an opening 30 through which a carabiner (not shown, see FIG. 7) is fixed.

Figure 5:
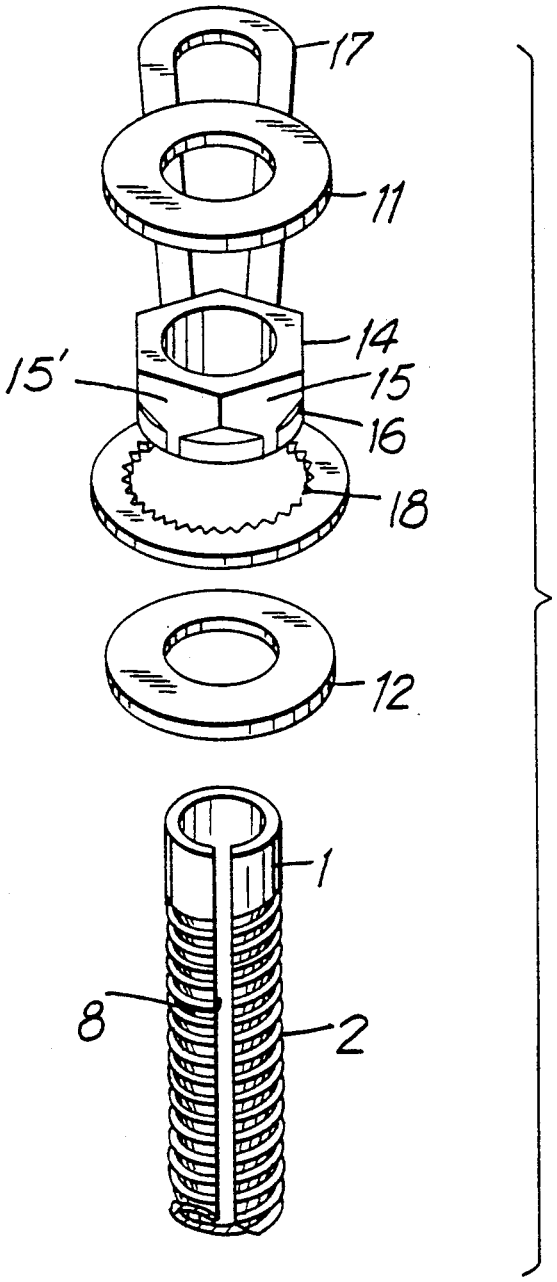
FIG. 5 is an exploded oblique view of the interrelationship of the flanges, handle and intermediate section of the piton.

FIG. 5 depicts an exploded oblique view of the flanges and handle elements comprising a specific part of the invention. Tubular shaft 2 is not shown with its truncated end as it is depicted merely to show its relationship to the pieces when assembled. Flanges 11 and 12 are separated by ring attachment 13 that comprises a bolt-like element 14 having multifaceted surface 15, 15' etc. around the periphery, and a circular peripheral portion 16. Opening 18, of element 18 forming a part of handle 17 has the configuration nominally of a box wrench wherein the facets fit snugly across the bolt-like flats of the multifaceted peripheral surface 15 of said first portion 14 of the ring attachment. Opening 18, normally rests atop said second flange 12 and is capable of rotating 360° around the circular portion of said ring attachment.

Figures 6, 7:
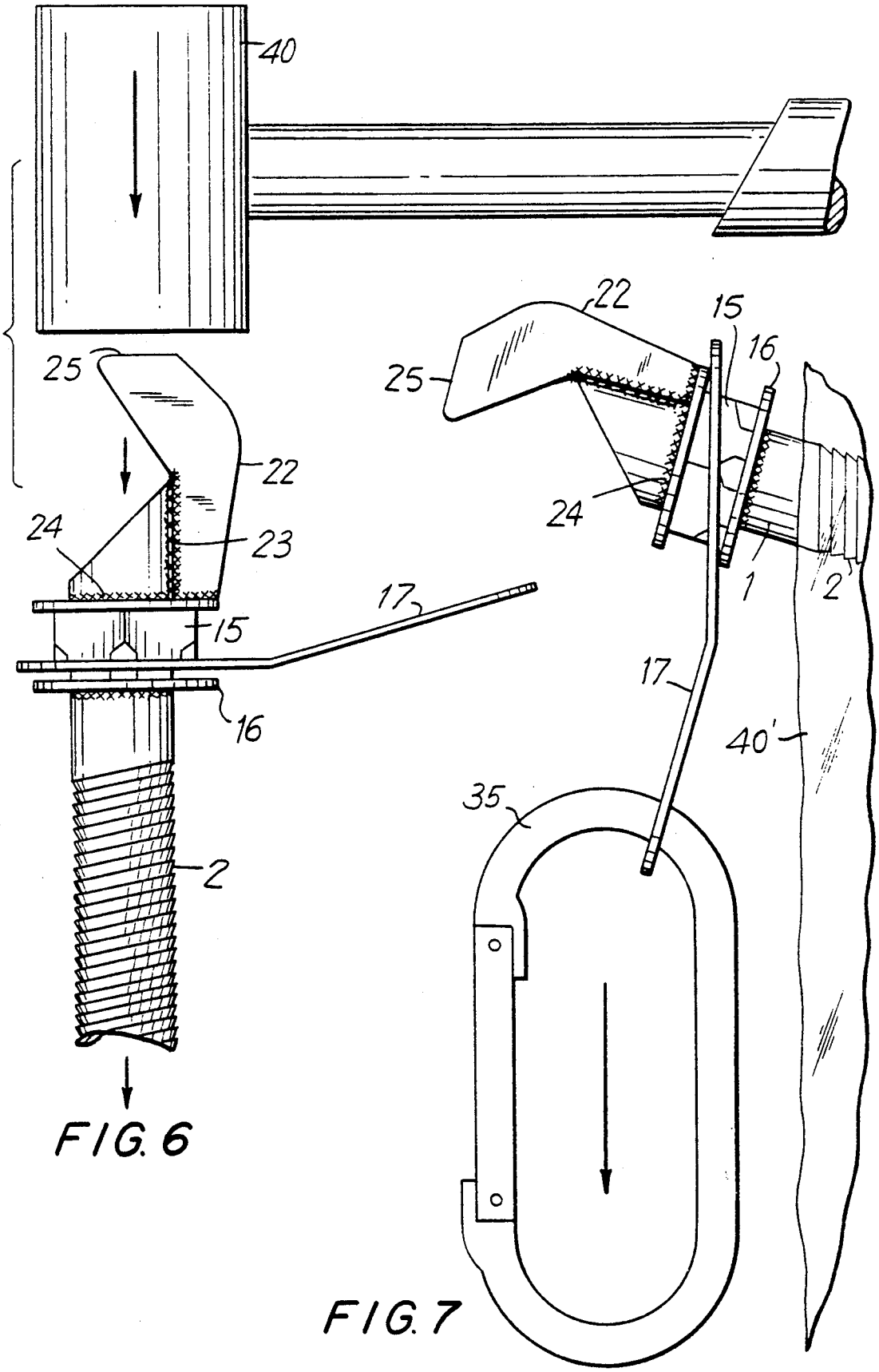
FIG. 6 depicts a means directing a force down the center of the tube which drives the assembly into the ice.
FIG. 7 depicts the handle of the secured piton providing climbing protection and a carabiner secured thereto.

The ice climbing protection provided by the piton herein described is the result of its being secured into a frozen surface. As shown in FIG. 6 a convenient way of inserting the piton into the frozen surface is by impacting same with a blow from a hammer 40 or other suitable instrument applied to the top surface 25 of ear 22 which transmits the force down through ear 22 through lip 26 and accordingly down along shaft 2. Shaft 2 does not depict the threaded surface as shown in FIG. 1. 24 can be by welding or any convenient means and is a structural feature, not a load bearing one, thereby virtually eliminating or reducing a fracture in the medium in which the piton is secured resulting from shear forces. This allows shaft 2 to receive the direct force applied to the ear top surface 25 at lip 26.

The slot or spline 9 in shaft 2 of FIG. 1 is present in the piton to allow for the extraction from the ice. Once the piton is secured in the ice, handle 17 by means of opening 18 provides a swivel assembly when at rest that rotates and possesses an opening 30 into which a carabiner can be clipped. When the wrench-like handle is moved into position to engage the bolt-like portion of the ring attachment 13 the handle is rotated and the piton shaft is removed from the ice be essentially unscrewing same.

FIG. 7 depicts piton 1 in place in the ice 40 with a carabiner 35 clipped through opening 30 of handle 17.

As noted above, generally, the two mediums involved in technical climbing are rock and ice. Rock climbing is done with the hands while ice climbing is done with sharp ice axes and crampons which are metal spikes affixed to the feet. Ice Climbing is most often undertaken in pairs, with a rope having a standard length of, for example, 50 meters separating the two climbers. The first climber, commonly called a leader, ties the rope to a waist harness and begins to climb. The other climber, commonly called a second, holds the rope through a friction device and plays the rope out slowly as the leader moves upward.

As the leader ascends the frozen ice, he or she either screws or hammers the piton of the present invention into the ice and attaches the rope to it with a metal clip called a carabiner. This situation wherein the piton is fixed in the ice is depicted in FIG. 9. The ice climbing protection is now between the leader and the second. If the second is holding the rope properly and the ice climbing protection comprising the piton remains firmly in the ice, the leader in the event of a slip will fall only twice the distance from the last piton fixed in the ice. The piton receives its holding power from the tensile strength of the metal, the angle at which it is placed, the holding action of the teeth on the outside of the tube, and by the ice in the center of the tube refreezing with the ice around the outside of the tube. A leader normally places between three and six pitons per rope length.

Upon reaching the top of the vertical rise to be scaled, or after about 50 m, whichever comes first, the leader attaches him/herself to the ice. The leader then signals the second who starts to climb. As the second starts to climb, the leader pulls up the rope. When the second reaches a piton he or she unscrews it from the ice using the handle and raising same to fit the bolt-like section on and unscrewing the piton from the ice. Thereafter climbing resumes.

Climbers move in many directions relative to the piton besides straight up and down and the variable position provided by the present invention eliminates the concern of a climber as to the direction that the ice piton is placed. The strength of the placement of the device is related only to the downward forces on the frozen medium due to its constant downward angle from the shaft placement.

In addition to functioning throughout a 360° swivel position, handle 17 is also suitable for use as a wrench so that when the flats of the corresponding bolt head are engaged by the wrench-like configuration of handle opening 18, the handle is rotated and accordingly the entire piton assembly rotates and the threads 3 allow one to remove the threaded shaft from the ice medium.

Having thus described our invention, what we claim and desire to protect by Letters Patent is:

1. An improved ice piton assembly suitable for fixing in an ice-like medium comprising:

a tubular externally threaded hollow shaft having a first end that is substantially bevelled and having a second end with a truncated configuration so that when measuring from said first end, there is a point of maximum length on said second end and diametrically across from said maximum length point, a point of minimum length, said shaft possessing a slot extending along a portion of the length of said shaft through said minimum point of said second end, and at a distance removed from said minimum point of said second end, a first flange and a second flange separated by a ring attachment positioned over said shaft, the first portion of said ring attachment comprising a bolt head-like multifaceted peripheral surface and immediately adjacent thereto a second portion comprising a circular peripheral surface, and a handle attachment, having at one end, an opening positioned between said first and said second flanges, the interior of said opening having the configuration comprising facets sufficient to mesh with said bolt head-like multifaceted peripheral surface and when at rest capable of rotating freely around the circular surface of said ring attachment said handle at the other end thereof having an opening suitable for attaching a carabiner thereto;

a notch substantially positioned through said shaft at the point of maximum length to which is fixed an ear piece extending above said shaft and said first flange, said ear piece having a horizontal bottom lip piece that rests in said notch, said ear piece being affixed to said shaft and said flange.

* * * * *